United States Patent [19]

Goldstein

[11] Patent Number: 5,042,768

[45] Date of Patent: Aug. 27, 1991

[54] SHELF MOUNTING ADVERTISING DEVICE

[76] Inventor: Sol Goldstein, 300 Edward St., Roslyn, N.Y. 11577

[21] Appl. No.: 538,723

[22] Filed: Jun. 15, 1990

[51] Int. Cl.[5] ..... A47B 96/06

[52] U.S. Cl. ..... 248/225.1; 211/57.1; 40/650

[58] Field of Search ..... 248/225.1; 211/57.1; 40/124.1, 651

[56] References Cited

U.S. PATENT DOCUMENTS 4,919,377 4/1990 Alexander ..... 248/225.1

*Primary Examiner*—Alvin C. Chin-Shue

*Attorney, Agent, or Firm*—Arthur L. Plevy

[57] ABSTRACT

A device for advertising products on retail store shelving which includes an advertising placard adapted to be suspended from a shelf. The placard includes an elongated card which is folded to form a front panel and a side panel. The side panel is positioned substantially at right angles to the front panel and its upper edge abuts against the shelf when suspended from the front edge of the shelf by a suspender strap. The side panel supports the front panel at a predetermined angle relative to the vertical. The side panel may bear advertising indicia thereon which is visible when viewed from the side and may be supported in its angular displacement from the front panel by a return panel which transverses the distance between the distal end of the side panel and the reverse side of the card.

5 Claims, 1 Drawing Sheet

SHELF MOUNTING ADVERTISING DEVICE

BACKGROUND OF THE INVENTION

1. Field of the Invention

The present invention relates to a advertising device, and more particularly to folding placard adapted to be hung from a shelf and for displaying advertising indicia on at least two surfaces thereof.

2. Description of the Prior Art

A common means for attracting the attention of consumers to products displayed upon the shelves of a store is a shelf mounted advertising placard. These advertising devices are frequently held in tracks along the front edge of shelves typically utilized in retail stores. They are displayed proximate the actual product on the shelf. It has recently become a common practice to include tear-off forms on such advertising placards for use in participation by the consumer in a promotional offer, such as a rebate offer or a chance to win a prize from a drawing, or the like. As there is such a large variety of advertising and products displayed in the average store, all designed to attract the consumers attention, it is difficult for an individual product or ad to stand out. This is particularly true when considered from the perspective of a shopper who is glancing down a shopping aisle. Common advertising placards have messages which are visible only when viewed by a person positioned directly in front of it, i.e., they bear indicia in one plane only. Besides their obscurity when viewed from the side, known placard-type shelf display devices are deficient in that they have no provision for supporting the display surface and/or tear-off forms in a maximally visible plane and/or to promote ease of form removal.

SUMMARY OF THE INVENTION

The problems and disadvantages associated with the conventional techniques and devices utilized to advertise consumer products on display on shelves in a retail outlet are overcome by the present invention which includes An advertising placard adapted to be suspended from a shelf which includes an elongated backing card having a fold therein defining a front panel and a side panel. The side panel is positioned by folding along the fold line to extend substantially at right angles to the front panel. A suspender is affixed at one end to the backing card front panel and affixes at another end to the shelf thereby suspending the backing card from the shelf. The side panel has an upper edge which abuts against the shelf when the backing card is suspended from the shelf by the suspender, whereby the side panel supports the front panel at a predetermined angle relative to the vertical.

BRIEF DESCRIPTION OF THE FIGURES

For a better understanding of the present invention, reference is made to the following detailed description of an exemplary embodiment considered in conjunction with the accompanying drawings, in which.

DETAILED DESCRIPTION OF THE FIGURES

Figure 1:
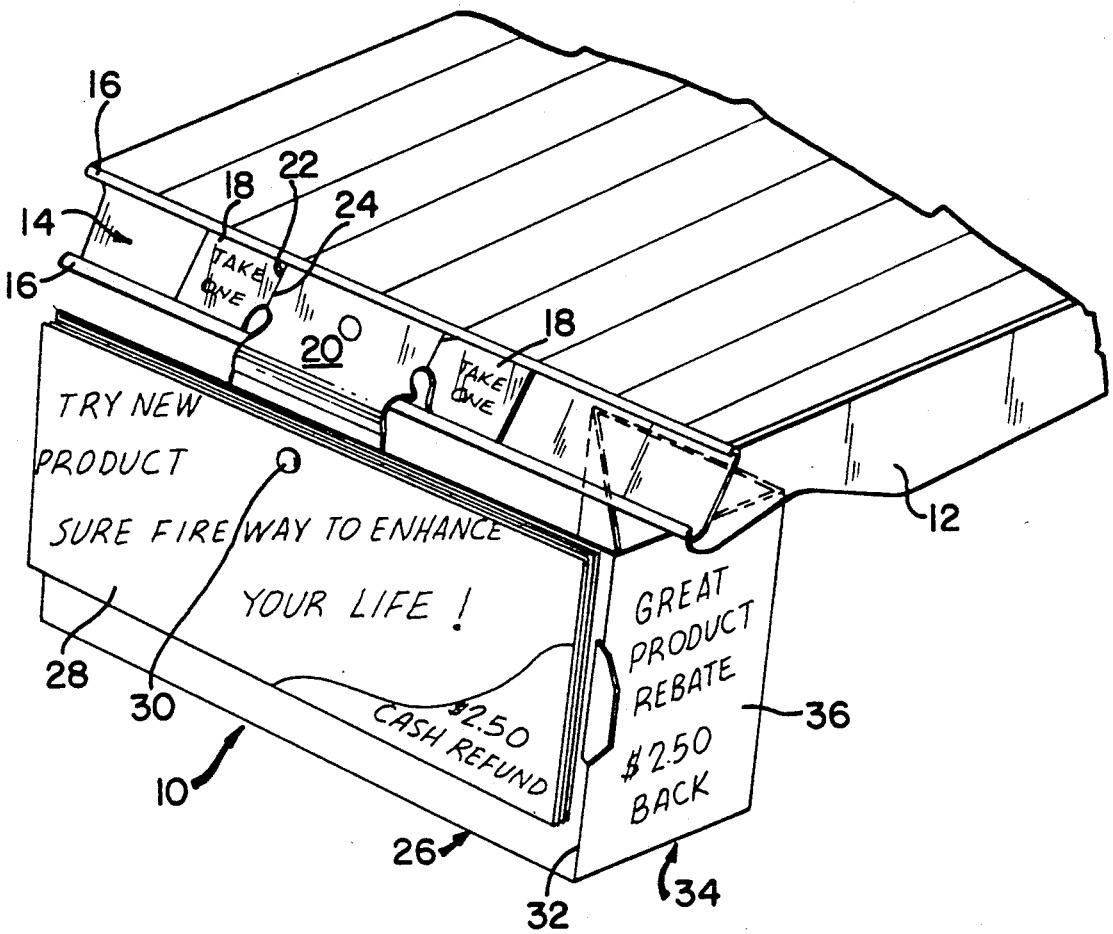
FIG. 1 is a perspective view of a shelf mounted advertising placard bearing removable sheets upon which are imprinted advertising indicia. A side support and display member is depicted partially in phantom view.

FIG. 1 shows an advertising placard 10 in accordance with an exemplary embodiment of the present invention suspended from a shelf 12. The shelf 12 is of the type as is commonly used in retail stores and has a concave front edge 14 bordered by top and bottom retainer lips 16. The front edge 14 is designed to receive and removeably retain a suitably dimensioned flexible plate which is bent and inserted between the retainer lips 16. Initially, the front edge 14 was designed to retain price information only but it was later learned that it could be used to receive a hanger for suspending a promotional or advertising device. In accordance with the later practice and the present invention, an advertising placard 10 is suspended by a pair of flexible tabs 18 extending from either side of a central suspender strip 20. The tabs 18 and suspender strip 20 are preferably formed as a single unit in a single process such as stamping or molding from a sheet of polymer film. The tabs 18 are free to be bent independently from the suspender strip 20 at least partially by relief notches 22 and by fold lines 24. A backing card 26 preferably formed from a good grade of shiny cardboard and a stack of tear-off promotional sheets 28 are suspended from the suspender strip 20 by a rivet 30 which extends through all three. Normally the stack of promotional sheets 28 would be bonded along one edge by glue to promote orderly individual dispensing. The backing card 26 is bent backwards along a set of fold lines 32 to form a support member 34 having a side display panel 36.

Figure 2:
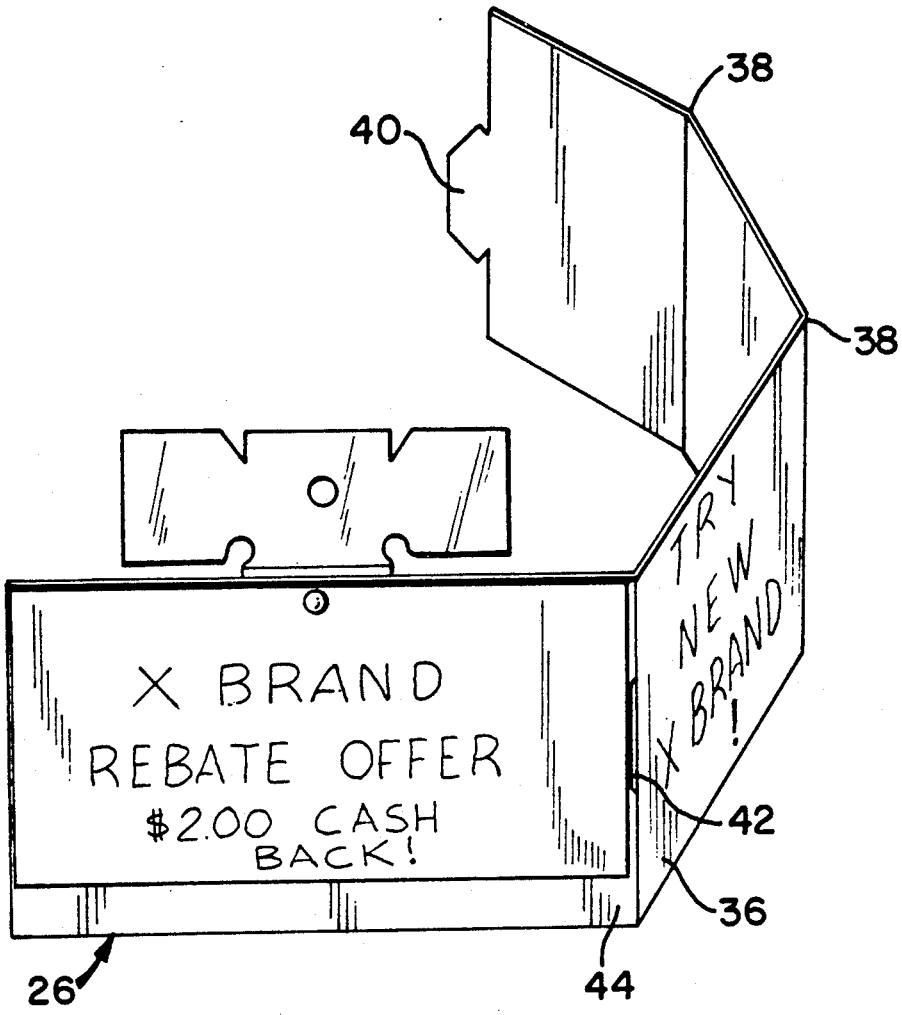
FIG. 2 is a perspective view of the device of FIG. 1 removed from its shelf mounting and unfolded.

Referring now to FIG. 2, an exemplary embodiment of the present invention is shown prior to folding and installation on a shelf. The folding of the backing card 26 renders a side panel 36 for bearing indicia to be displayed to a shopper who directs their attention down an aisle, as opposed to viewing the device when directly in front of it. An additional fold line 38 permits the backing card 26 to be folded back upon itself to permit a tab 40 at an end thereof to be inserted into a suitable slot 42 proximate the front panel 44 to secure the backing card 26 into a triangular configuration. Of course the folds could be made to render other configurations, such as a box shape. Similarly, the tab could be replaced by, e.g., gluing or stapling. The tab 40 may be folded over parallel to the front panel 44 and/or may be inserted under the promotional sheets 28 to enhance retention within the slot 42 and to yield a neat appearance.

It should be appreciated by the foregoing description that the present invention is an inexpensive but effective shelf-mounted advertising placard that simultaneously provides advertising on a side panel as well as enhanced support for the front display panel to increase viewing effectiveness and aid in promotional sheet removal.

It should be understood that the embodiments described herein are merely exemplary and that a person skilled in the art may make many variations and modifications without departing from the spirit and scope of the invention as defined in the appended claims.

I claim:

1. An advertising placard adapted to be suspended from s shelf which comprises:

a) an elongated backing card having a first fold therein defining a front panel and a side panel adapted to be positioned to extend substantially perpendicularly therefrom;

b) means for suspending said backing card from said shelf, said suspending means affixed at one end to said backing card front panel and affixable at another end to said shelf, said side panel when folded extending toward and under said shelf and having an upper edge which abuts against said shelf when said backing card is suspended from said shelf by said suspending means, whereby said side panel supports said front panel at a predetermined angle relative to the vertical wherein said backing card has a second fold therein defining a return panel extending from said side panel distal to said front panel, said return panel affixing to said front panel to support said side panel at a predetermined angle relative to said front panel, wherein said return panel is divided into a first and second portion by a third fold, said first portion extending from said second fold to said third fold, said second portion extending from said third fold to said front panel, and a tab protruding from said second portion, said first portion is displaced from said side panel by approximately 90 degrees at said second fold, said side panel, said first portion and said second portion forming a right triangle, said second portion forming the hypotenuse of said triangle.

2. A device in accordance with claim 1, wherein said side panel includes advertising indicia thereon.

3. A device in accordance with claim 2, wherein said return panel affixes to said backing card via the reception of said tab protruding from a terminal end of said return panel distal to said second fold within a slot in said front panel proximate said first fold.

4. A device in accordance with claim 2, wherein a stack of tear-off promotional sheets are affixed to said front panel.

5. A device in accordance with claim 2, wherein said suspension means includes a T-shaped member formed from a flexible polymer sheet, the top of said T-shaped member being defined by a pair of deformable tabs extending in opposite directions from a central strip, said tabs being retainable between the retainer lips of the front edge of conventional retail store shelving, said backing card at said front panel affixed to said central strip distal to said tabs.

* * * * *